US011585525B2

(12) United States Patent
Egitto

(10) Patent No.: US 11,585,525 B2
(45) Date of Patent: Feb. 21, 2023

(54) ILLUMINATED DISPLAY DEVICE

(71) Applicant: Signature Brands, LLC, Ocala, FL (US)

(72) Inventor: James Egitto, Ocala, FL (US)

(73) Assignee: SIGNATURE BRANDS, LLC, Ocala, FL (US)

( * ) Notice: Subject to any disclaimer, the term of this patent is extended or adjusted under 35 U.S.C. 154(b) by 0 days.

(21) Appl. No.: 17/411,781

(22) Filed: Aug. 25, 2021

(65) Prior Publication Data

US 2022/0065437 A1 Mar. 3, 2022

Related U.S. Application Data

(60) Provisional application No. 63/073,220, filed on Sep. 1, 2020.

(51) Int. Cl.

| | |
|---|---|
| ***F21V 33/00*** | (2006.01) |
| ***F21V 7/00*** | (2006.01) |
| ***F21V 21/08*** | (2006.01) |
| ***F21W 121/00*** | (2006.01) |

(52) U.S. Cl.

CPC ..... *F21V 33/0028* (2013.01); *F21V 7/0075* (2013.01); *F21V 21/0824* (2013.01); *F21W 2121/00* (2013.01)

(58) Field of Classification Search

CPC ..... F21V 7/0075; F21V 33/0028; F21V 21/0824; F21S 9/02; F21W 2121/00

See application file for complete search history.

(56) References Cited

U.S. PATENT DOCUMENTS

| | | | | |
|---|---|---|---|---|
| 2,006,251 A * | 6/1935 | Rollins | F21V 3/023 | 362/197 |
| 2,428,133 A * | 9/1947 | Yogan | G09F 19/02 | 446/485 |
| 2,685,022 A * | 7/1954 | Root | A63H 33/22 | 362/806 |
| 2,880,408 A * | 3/1959 | Sewell | B60Q 1/44 | 116/37 |
| 3,244,872 A * | 4/1966 | Mccormick | F21V 3/023 | 40/540 |
| 3,250,910 A * | 5/1966 | Authier | F21V 3/023 | 40/540 |
| 4,263,743 A * | 4/1981 | Hanson | G09F 19/08 | 446/329 |

(Continued)

*Primary Examiner* — Jong-Suk (James) Lee
*Assistant Examiner* — James M Endo
(74) *Attorney, Agent, or Firm* — Cozen O'Connor

(57) ABSTRACT

An illuminated display device for a hollowed-out pumpkin having face holes, the illuminated display device being installable in an inner volume of the pumpkin that is carved as a jack-o-lantern having the face holes and positioned at a front outer surface of the pumpkin, includes: a light bearing substrate; a light source emitting light substantially omni-directionally, the light source being arranged on the light-bearing substrate; a spike configured to be releasably engageable with an inner surface of the jack-o-lantern to secure the positioning of the lighting device within the jack-o-lantern proximate one of the face holes; and a reflector to direct light from the light source through at least one face hole to provide the impression to a viewer, if the face hole is an eye cutout, that the eye of the jack-o-lantern is following a passerby.

15 Claims, 7 Drawing Sheets

(56) References Cited

U.S. PATENT DOCUMENTS 5,091,833 A * 2/1992 Paniaguas ..... F21V 33/0028 428/17
5,918,964 A * 7/1999 Bou ..... F21V 33/0028 362/186
6,035,447 A * 3/2000 Hsia ..... A41G 7/02 2/202
6,224,234 B1 * 5/2001 Demmery ..... A45C 15/06 362/208
6,309,092 B1 * 10/2001 Bardeen ..... F21V 21/08 362/202
7,410,270 B2 * 8/2008 Long ..... A45C 15/06 362/108
8,220,964 B1 * 7/2012 Martin ..... F21V 33/0028 362/362
9,022,595 B1 * 5/2015 Schilling ..... F21V 33/0028 362/154
2003/0031009 A1 * 2/2003 Fan ..... F21S 10/04 362/234
2003/0067770 A1 * 4/2003 Bonnema ..... F21V 35/00 362/372
2003/0067790 A1 * 4/2003 Brown ..... F21S 10/04 362/240
2003/0210555 A1 * 11/2003 Cicero ..... B44C 5/005 362/555
2006/0176703 A1 * 8/2006 Cayton ..... 362/240
2006/0250789 A1 * 11/2006 Coushaine ..... F21V 15/01 362/157
2007/0189003 A1 * 8/2007 Daley ..... A41G 7/02 362/105
2008/0105817 A1 * 5/2008 Damman ..... F21V 33/008 248/684
2014/0198478 A1 * 7/2014 Ksobiech ..... F21V 21/0824 362/122
2016/0223161 A1 * 8/2016 Noblitt ..... F21V 19/0055
2016/0223174 A1 * 8/2016 Inscore ..... F21V 23/005
2017/0252659 A1 * 9/2017 Kreps ..... A63H 3/006
2018/0094804 A1 * 4/2018 Brannagan ..... F21V 23/06
2020/0080708 A1 * 3/2020 Xiao ..... F21V 17/164
2021/0088193 A1 * 3/2021 Hou ..... F21S 9/02

* cited by examiner

ILLUMINATED DISPLAY DEVICE

CROSS-REFERENCE TO RELATED APPLICATION

This application claims benefit under 35 U.S.C. 119(e) of U.S. Provisional Patent Appln. No. 63/073,220, filed Sep. 1, 2020, the entirety of which is incorporated by reference herein.

BACKGROUND OF THE INVENTION

1. Field of the Invention

The invention relates to a display device for a holiday display. More particularly, the present invention is directed to an illuminated display device positioned inside a hollowed-out pumpkin, melon, or the like, having carve-outs, such as in a jack-o-lantern, having a face, for illuminating features in the face.

2. Discussion of Related Art

A jack-o-lantern is a carved pumpkin, turnip, melon or similar food usually associated with Halloween. Its name is derived from the phenomenon of a strange light flickering over peat bogs, called will-o'-the-wisp or jack-o-lantern.

To produce such an effect it is known, for example, to cut face holes (e.g., eye holes, nose and/or mouth holes) into a hollowed-out pumpkin, melon, etc. and place a light source, traditionally a candle but more presently a battery-powered light, inside the pumpkin to illuminate the face holes from the inside. However, such light sources are not easily adjustable, do not firmly affix to the inside of the pumpkin, and do not have any directionality feature to ensure the most intense light is emitted in any particular manner. In addition, when such a jack-o-lantern is moved from one location to another, the light source will typically be jostled and will require adjustment.

The ability to provide a device for a jack-o-lantern or similar display having directionality features of the light source and an ability to alleviate the need to readjust the light source after such display is moved will enhance the novelty and visually pleasing effect of the display.

SUMMARY OF THE INVENTION

In accordance with one aspect of the present invention, an illuminated display device includes a housing having an anchoring feature, such as one or more spikes configured penetrate an inner wall of a hollowed-out pumpkin, the spikes being configured to removably secure the illuminated display device in position within the pumpkin. A light source on the illuminated display device produces light, at least a portion of which is directed away from the front of the pumpkin, namely, away from a front surface of the hollowed-out pumpkin and, in particular away from the surface containing a jack-o-lantern "face" made of face holes. A reflector is provided at a rear portion of the illuminated display device, namely distally away from the face and angled toward the face to reflect light from the light source through the face holes. When mounted in the inside of the pumpkin below eye holes, the reflector and the light source are configured and dimensioned such that the reflected light provides to a viewer of the pumpkin face with an illusion that the eyes of the pumpkin are watching the user as the user moves past the jack-o-lantern. In other words, an illusion that the "eyes" of the jack-o-lantern are following a passerby is produced. The spikes hold the light device by being inserted into the side of the inner wall of the pumpkin such that if movement of the jack-o-lantern display from one location to another is desired, the light device remains in its proper position inside the jack-o-lantern. Preferably, a separate illuminated display device is used for each eye hole to provide the desired effect to an observer that the eyes of the jack-o-lantern are following the observer as the observer passes.

In accordance with another aspect of the invention, an illuminated display device is described for use with a hollowed-out pumpkin or other container having face holes, the illuminated display device being installable in an inner volume of the container that is carved in a jack-o-lantern configuration having at least the face holes and positioned at a front outer surface of the pumpkin. The display device includes: a light bearing substrate; a light source emitting light substantially omnidirectionally, the light source being arranged on the light-bearing substrate; a spike configured to be releasably engageable with an inner surface of the jack-o-lantern to secure the positioning of the illuminating display device within the jack-o-lantern proximate one of the face holes; and a reflector connected to the light bearing substrate and positioned distally from the spike, the reflector arranged to extend at an angle with respect to the light bearing substrate and toward the spike and above the light source to direct light from the light source through at least one face hole to provide the impression, in the event the face hole is an eye cutout, that the eye of the jack-o-lantern is following a passerby.

In another aspect, the light is directed by the reflector by reflection.

In another aspect, the illuminated display device further includes a main housing, configured to cover the light bearing substrate and have an aperture at its top to permit the light source to protrude through the aperture.

In another aspect, the spike comprises a pair of spikes symmetrically arranged so as to protrude outward from the front of the illuminated display device.

In another aspect, each of the spikes has a shaft, a pointed tip and at least one barb arranged on the shaft, the at least one barb being configured to facilitate installation of the illuminated display device into the flesh of pumpkin at the inner surface of the jack-o-lantern, but to inhibit removal of the illuminated display device once it has been installed.

In another aspect, the reflector is coupled to a rear portion of the light-bearing substrate so as to hold the reflector at an angle so that the light from the light source is emitted through the face holes of the container.

In another aspect, the illuminated display device further includes a battery configured to selectively provide electric power to the light source to cause the light source to light.

In another aspect, the illuminated display device further includes a battery door openably affixed to the bottom of the illuminated display device, an upper surface of the battery door and an inner surface of the light substrate cooperating to form a battery chamber.

In another aspect, the illuminated display device further includes an ON/OFF slide switch configure to reciprocate between a first ON position in which current flows from the battery to the light source and a second OFF position in which light cannot flow from the battery to the light source.

In another aspect, the reflector is configured to reciprocate between a storage position and an upright tilted operational angle.

In another aspect, the face holes comprise a pair of eye cutouts

In another aspect, the reflector comprises a plate of transparent material

In another aspect, the reflector extends from the bottom of the illuminated display device in a direction toward the front and above the light source.

In another aspect, the hollowed-out container is a pumpkin.

In another aspect, the light source has a transparent or translucent cover that is configured to color the light from the light source.

In another aspect, the substrate has a slot configured to receive a bottom of the plate/reflector.

In another aspect, the elements of the illuminated display device are integrally formed.

In another aspect, the reflector is made of plastic.

In another aspect, the reflector is hingedly connected to the light-bearing substrate so as to move between a first packaged flat position and a second deployed position at a desired operational angle.

In another aspect, in a method of assembling together the jack-o-lantern using two instances of the illuminated display device, the method includes: forming a jack-o-lantern having face holes, namely one or more eye holes from the pumpkin; deploying the reflector of each of the two illuminated display devices to the forward tilted operational angle; and inserting the spikes of each illuminated display device into locations beneath a respective one of the eye holes.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE DISCLOSED EMBODIMENTS

Elements in the figures in the detailed description are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of the illustrated elements.

The following description is not to be taken in a limiting sense, but is made merely for the purpose of describing exemplary embodiments. Reference throughout this specification to "one embodiment", "an embodiment", "some embodiments", "one form", or similar language means that a particular feature, structure, or characteristic described in connection with the embodiment is included in at least one embodiment of the present invention. Thus, appearances of the phrases "in one embodiment," "in an embodiment," "some embodiments", "in one form", "in another form", and similar language throughout this specification may refer to the same embodiment and/or may refer to separate or alternate embodiments as well. Furthermore, the described features, structures, or characteristics of the invention may be combined in any suitable manner in one or more embodiments.

Figure 1:
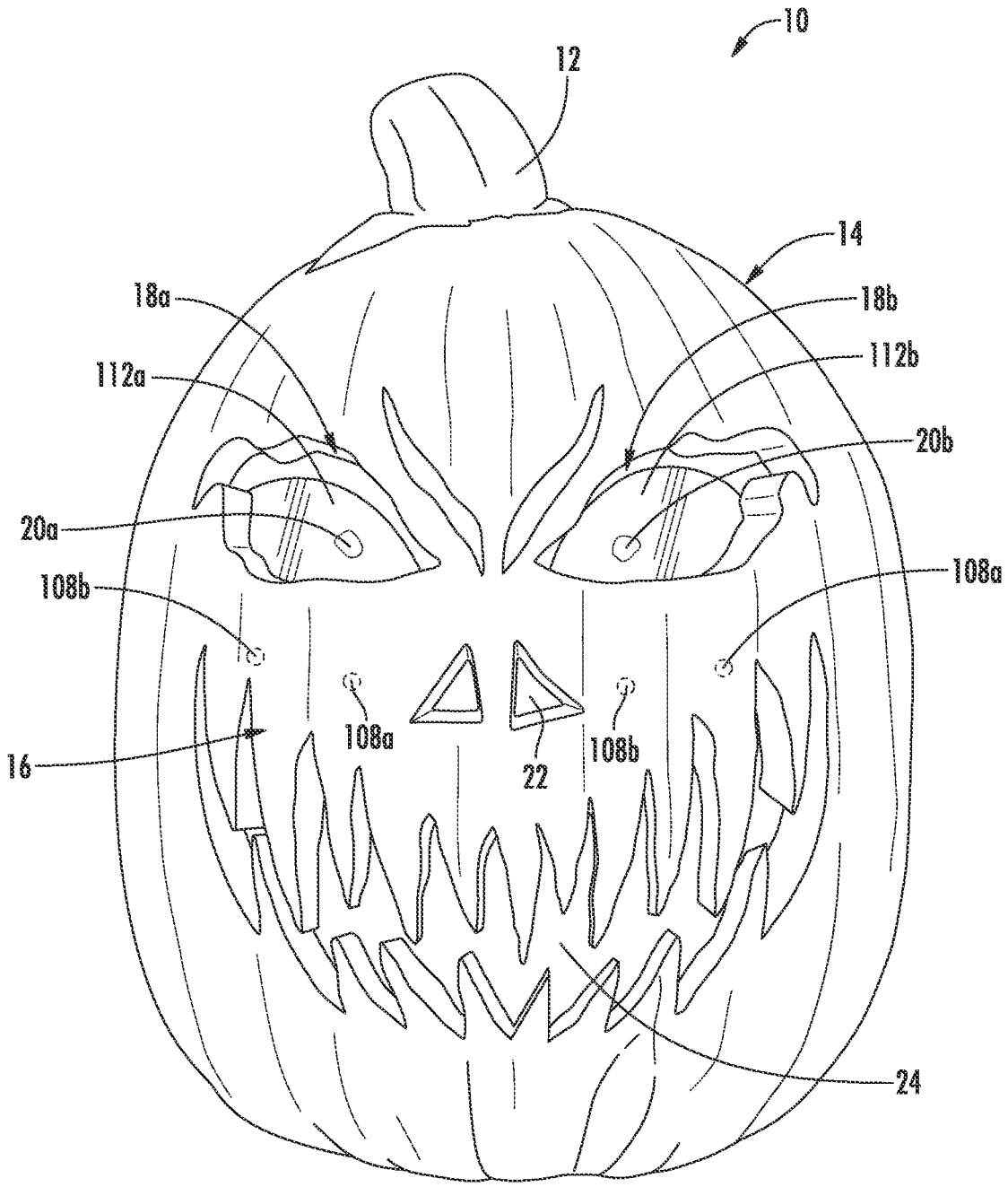
FIG. 1 is an elevation view of a jack-o-lantern display with two illuminated display devices (one for each eye hole) therein.
Figure 2:
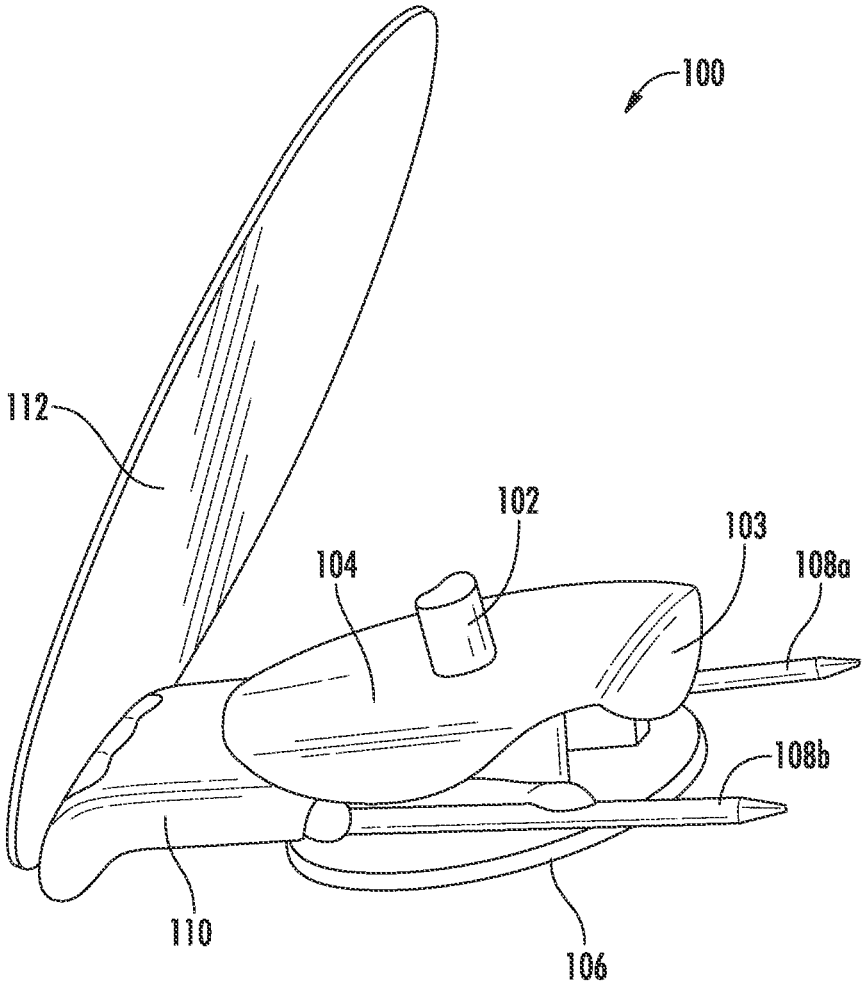
FIG. 2 is a perspective view of the illuminated display device according to an embodiment of the present invention.

FIG. 1 shows a jack-o-lantern 10 that has installed therein an illuminated display device 100 of the present invention which is discussed in detail in relation to FIG. 2.

As can be seen in FIG. 1, the jack-o-lantern 10 has a stem 12, an overall body 14 and a front face 16. As is typical of such jack-o-lanterns, the stem 12 may have been removed, along with surrounding pumpkin surface flesh, to allow access to the pumpkin interior for carving out of the interior, and then replaced. Alternatively, the pumpkin interior may have been removed from a cutting performed at a different part of the pumpkin's surface, for example from the rear face or bottom surface, in which instance no seam would be frontally visible around the stem 12.

As can be seen in FIG. 1, the front face 16 is decorated with face cutouts such as eye cutouts 18*a* and 18*b*, nose cutouts 22, and a mouth cutout 24. Just as in all jack-o-lanterns, these cutouts permit ambient light from an inside light source to escape.

In accordance with the present invention, at particular locations in the eye cutouts 18*a* and 18*b*, namely at regions 20*a* and 20*b* as seen by a viewer viewing the front face of the jack-o-lantern, high intensity areas of light are projected. Such high intensity light regions 20*a* and 20*b* are the result of the structural features of two instances of the illuminated display device 100, one associated with left eye cutout 18*b* and another associated with right eye cutout 18*a*, which will be discussed further below. Also visible in FIG. 1 are reflectors 112*a* and 112*b*, which are two instance of the reflector 112 shown in FIG. 2. As will be developed, two instances of the light device 100, one associated with each eye cutout, are implanted, i.e., installed within, the front inside flesh of the jack-o-lantern.

Also visible in phantom in FIG. 1, are the locations of spikes 108*a* and 108*b* below each eye cutout. In view of the fact that each device 100 preferably has two spikes, and the fact that one instance of the light device is provided for each eye, FIG. 1 has a total of four such indications in phantom.

FIG. 2 shows an exemplary instance of the illuminated display device 100 according to an embodiment of the present invention. The illuminated display device 100 includes a light source 102 provided on an upper surface of a light-bearing substrate 104. The upper surface of substrate 104 is made of or coated with a light absorptive opaque material which is dark or black in color. The light source 102 can be any appropriate light source, such as battery-powered tea lights, or other light sources, for example, LED light sources. The batteries may, for example, be arranged within the light-bearing substrate 104, for example, in a battery compartment. Preferably, the light source 102 is configured to project light substantially omnidirectional, and at least toward both the front and toward the rear of the pumpkin interior.

The light bearing substrate 104 is coupled to a spike substrate 106 that is arranged below the light bearing substrate 104. The spike substrate 106 has, projecting from a frontally oriented portion thereof, two spikes 108*a* and 108*b*. The spikes 108*a* and 108*b* being configured to project toward the flesh of the pumpkin interior lower surface, i.e., below the cutout for a respective one of the eye cutouts 18*a* and 18*b*.

In securing each instance of the illuminated display device 100 within the jack-o-lantern 10, each device 100 is placed at or near a respective one of the eye cutouts of the pumpkin's interior, and then the illuminated display device 100 is moved forward to impale the spikes 108*a* and 108*b* into the flesh of the pumpkin interior, but preferably not so far as to pierce through to the outer surface of the jack-o-lantern. In a preferred embodiment, a front surface of substrate 104 is configured as a forward motion stop 103 to prevent the spikes from extending too far through the wall of the pumpkin.

Once the spikes 108*a* and 108*b* for one device 100 have been impaled into the front of the inner flesh of the jack-o-lantern, preferably below a first one of the eye cutouts 18*a* and 18*b*, the procedure with be repeated for another illuminated display device 100, with respect to the other of the eye cutouts 18*a* and 18*b*. This implantation ensures that each respective device 100 will remain at a stable position relative to the jack-o-lantern.

In each instance of the illuminated display device 100, a rear substrate 110 extends rearwardly from the light bearing substrate 104 and laterally to the rear of the spike substrate 106. The rear substrate 110 and light bearing substrate 104, along with the spikes 108 may be integrally formed of an opaque material, such as a dark colored plastic exhibiting light-absorption properties. As show in the illustrative example, the rear substrate is positioned below the light bearing substrate 104 but it will be recognized by those of ordinary skill that such arrangement is a design choice and, alternatively, an upper surface of the rear substrate can be configured to be the light bearing substrate 104 with light element 102 extending upwardly therefrom.

Projecting upwardly from the rear portion of the rear substrate is a reflector 112. The reflector 112 projects upwardly from the rear substrate 110 at a forward angle, as shown in FIG. 2, preferably about 45 degrees forward. In the illustrated embodiment, the reflector is a round shaped flat piece of transparent reflective material, which may also have refractive characteristic, such as Plexiglas. Preferably, the diameter of the reflector is about 2.75 inches.

As mentioned above, light source 102 on the illuminated display 100 produces light at least a portion of which is directed away from the front of the pumpkin. The reflector 112 of each light device 100 is configured, with its forward tilt, and arranged at a rear portion of the illuminated display device 100, so as to reflect light from the light source 102 that is incident on the reflector 112 toward the front inner surface of the pumpkin, and, in particular, to direct respective light beams of relatively high intensity out of the front of the pumpkin/jack-o-lantern, in particular, out of the eye cutouts 18*a* and 18*b*. That is, due to the arrangement and configuration of the reflector 112 in relation to the inner dimensions of the pumpkin and the other components of the light device 100, at particular points in the eye cutouts 18*a* and 18*b*, namely at regions 20*a* and 20*b* as seen by a viewer viewing the front face of the jack-o-lantern, high intensity areas of light are projected from eye cutouts to provide the impression that the jack-o-lantern's eyes are staring at the viewer and follow the viewer as the viewer passes from left-to-right or from right-to-left in front of the jack-o-lantern.

In accordance with a particularly preferred embodiment, the reflector is configured so as to create the high intensity light regions 20*a* and 20*b*, to provide the visual impression to the user that the eyes of the jack-o-lantern are staring at the user. In a preferred embodiment, the reflector and the light source are configured and dimensioned such that the reflected light provides to a viewer of the pumpkin face with the visual impression of eye-to-eye contact, namely, that the eyes of jack-o-lantern are following the user as the user moves past the assembly.

To provide a correct angle between the reflector 112 and the base of the light device 100 for pumpkins of different sizes, the consumer of the inventive light device will preferably use an eye size that is an approximate size appropriate.

As mentioned above, in the deployed state of each instance of the light unit 100, the reflector 112 projects upwardly from the rear substrate 110 at a forward angle, as shown in FIG. 2. In one embodiment, the bottom of the reflector may be affixed at the deployment angle by a glue or of other manner of permanent affixing. However, for ease of packaging and transport, it is highly preferable if the reflector can be detachable/attachable or can be swiveled about a hinge so that the illuminated display device can be packages in a fairly flat configuration. For example, holes can be drilled in the base portion of the reflector, which can be penetrated by friction-fitted bosses protruding from the rear of the rear substrate 110. Another example is to have the bottom of the reflector and the back of the rear substrate have a hinged formation, which allows, for example, the reflector to be swiveled under and tucked under the spike substrate 106 for storage and reduction of size when not in use or during shipping.

Figure 3:
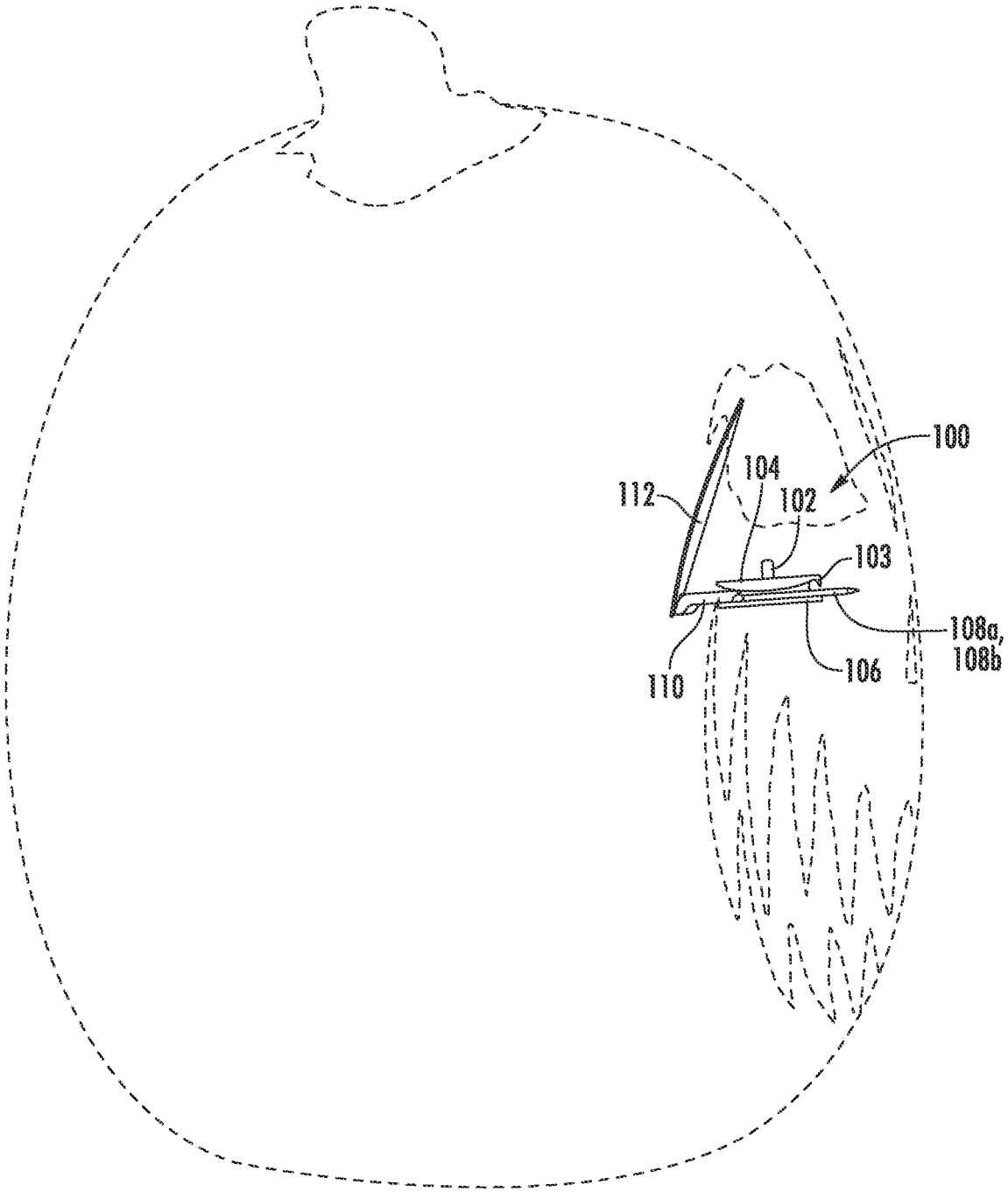
FIG. 3 is a side view showing attachment of one illuminated display device arranged within the jack-o-lantern, a second device being obscured by the first device.

One such preferred configuration, with a light unit 200, is illustrated in FIGS. 4-7. The pumpkin is not show in FIGS. 4-7 but a pair of the light units (illuminated display devices) 200 work together with the pumpkin in the same manner as shown in FIGS. 1-3.

Figure 4:
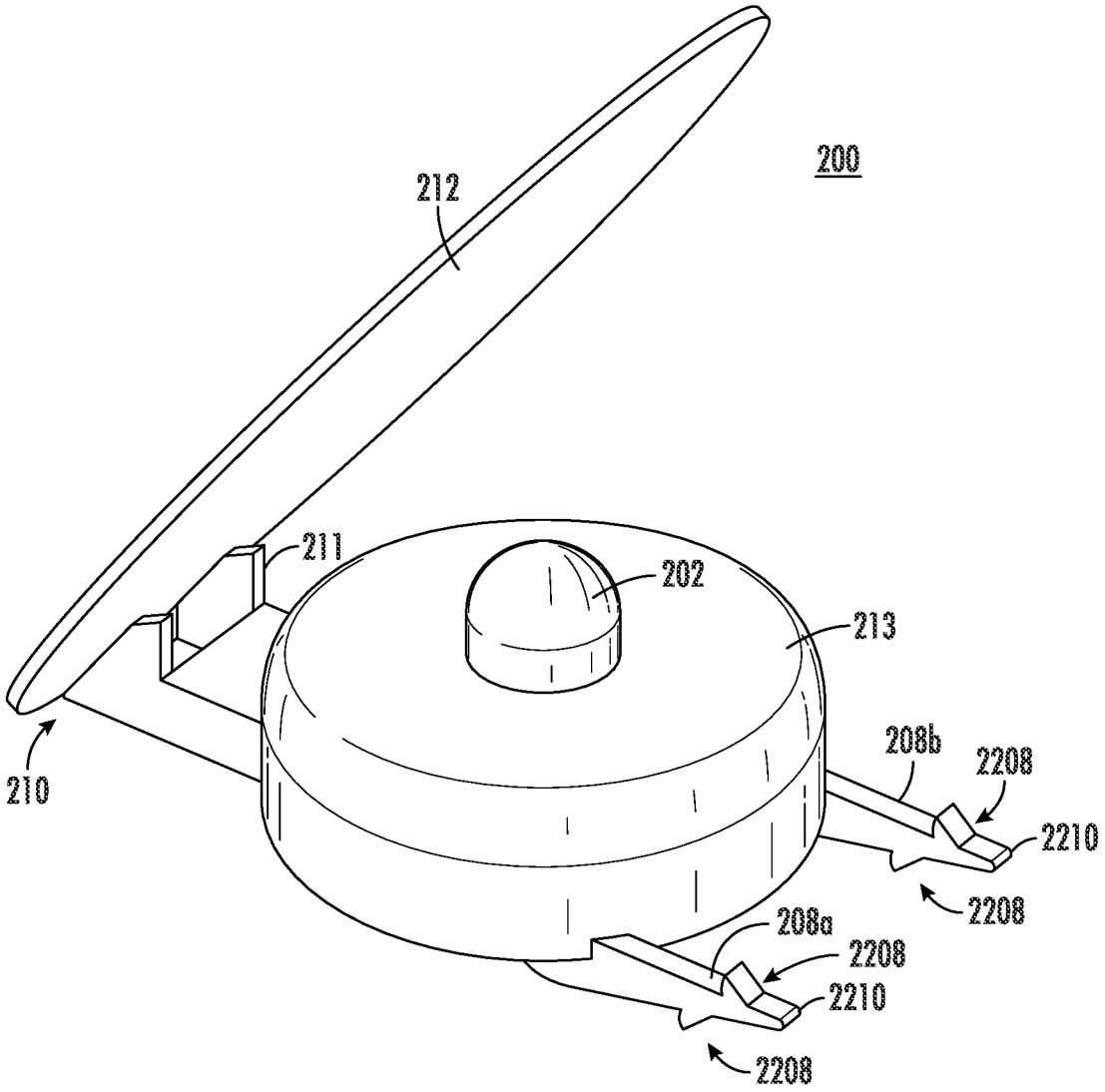
FIG. 4 is a perspective view of a second embodiment of an illuminated device according to a second aspect of the present invention.
Figure 5:
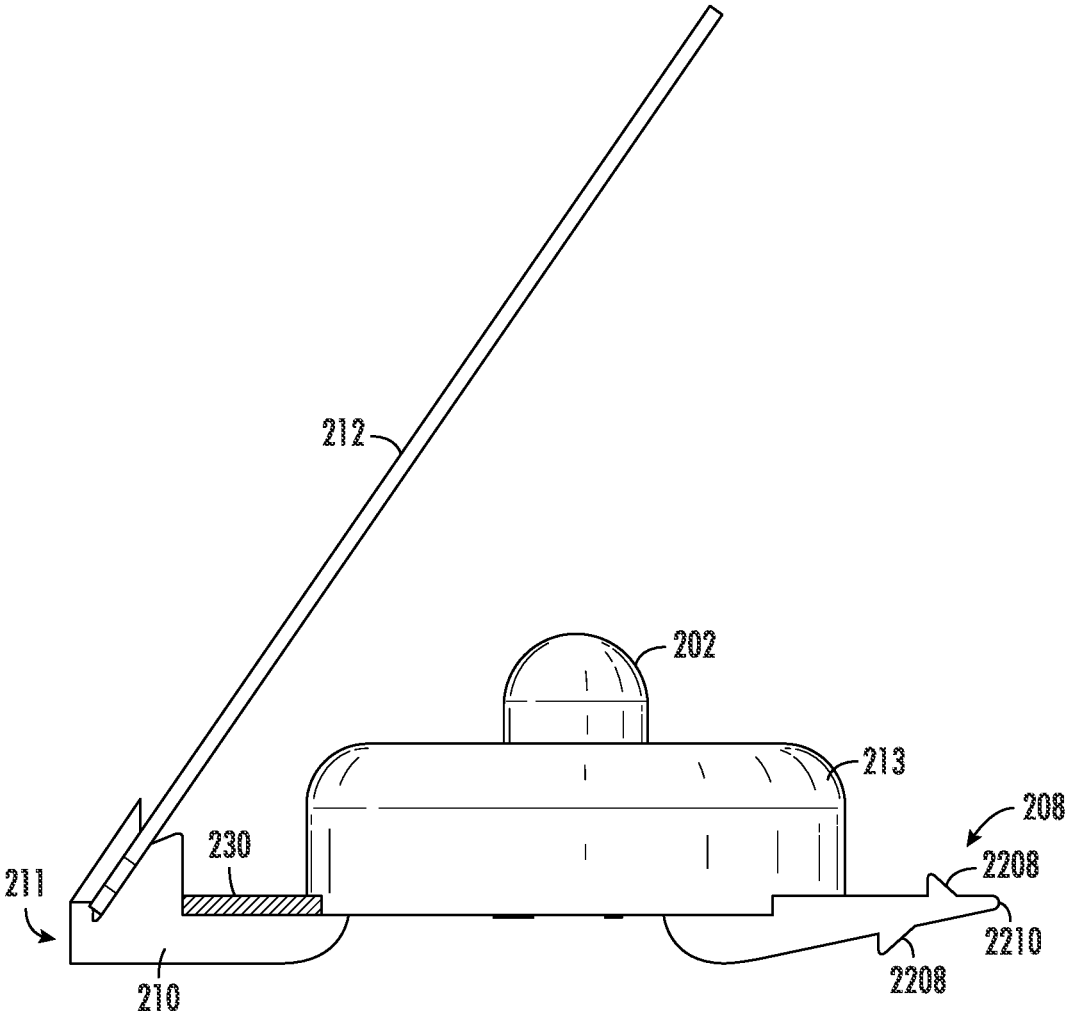
FIG. 5 is a side elevation view of the illuminated device shown in FIG. 4.

As can be seen in FIGS. 4 and 5, each light unit 200 includes a reflector 212, such as the reflector described above. The bottom of the reflector 212 is affixed to a lower substrate 210. The rear of the lower substrate 210 forms a part of the reflector clip/receiving slot 211, which is used to affix the reflector to the substrate.

A main housing 213 forms a dome that covers the electronics of the light unit 200. The main housing 213 has a hole, i.e., aperture, in its top through which the lighting device, in particular the light cover 202, passes through.

Spikes 208*a* and 208*b* are, in this aspect, shaped in a particular way to achieve secure attachment, i.e., insertion and retention, of the light unit 200 into the flesh of, e.g., a pumpkin. The secure attachment is facilitated by the provision of barbs 2208 on each spike, in addition to a sharp frontal point 2210. The barbs are contoured and angled to allow relatively easy penetration into the flesh of the pumpkin, but to make it relatively more difficult for the spikes to become dislodged once inserted past the depth of the barb.

As can be seen in FIG. 5, attaching the reflector 212 to the lower substrate 210 is achieved, in this aspect, by providing a receiving slot 211 at the rear of the lower substrate 210, either formed as a cutout in the substrate or by adding addition structure, which, when appropriately engaged with the substrate, forms a rear part of the slot 211. As discussed above in relation to light device 100, in the light device 200 there are a number of ways the bottom of the reflector could be affixed to the receiving slot 211. Preferably, to allow adjustment of the angle of the reflector 212 from a relatively flat profile appropriate for storage, and an upright angled position for reflection of the light as need for the functioning of the illuminated display device, a swivel structure can be included in the clip 211.

Figure 6:
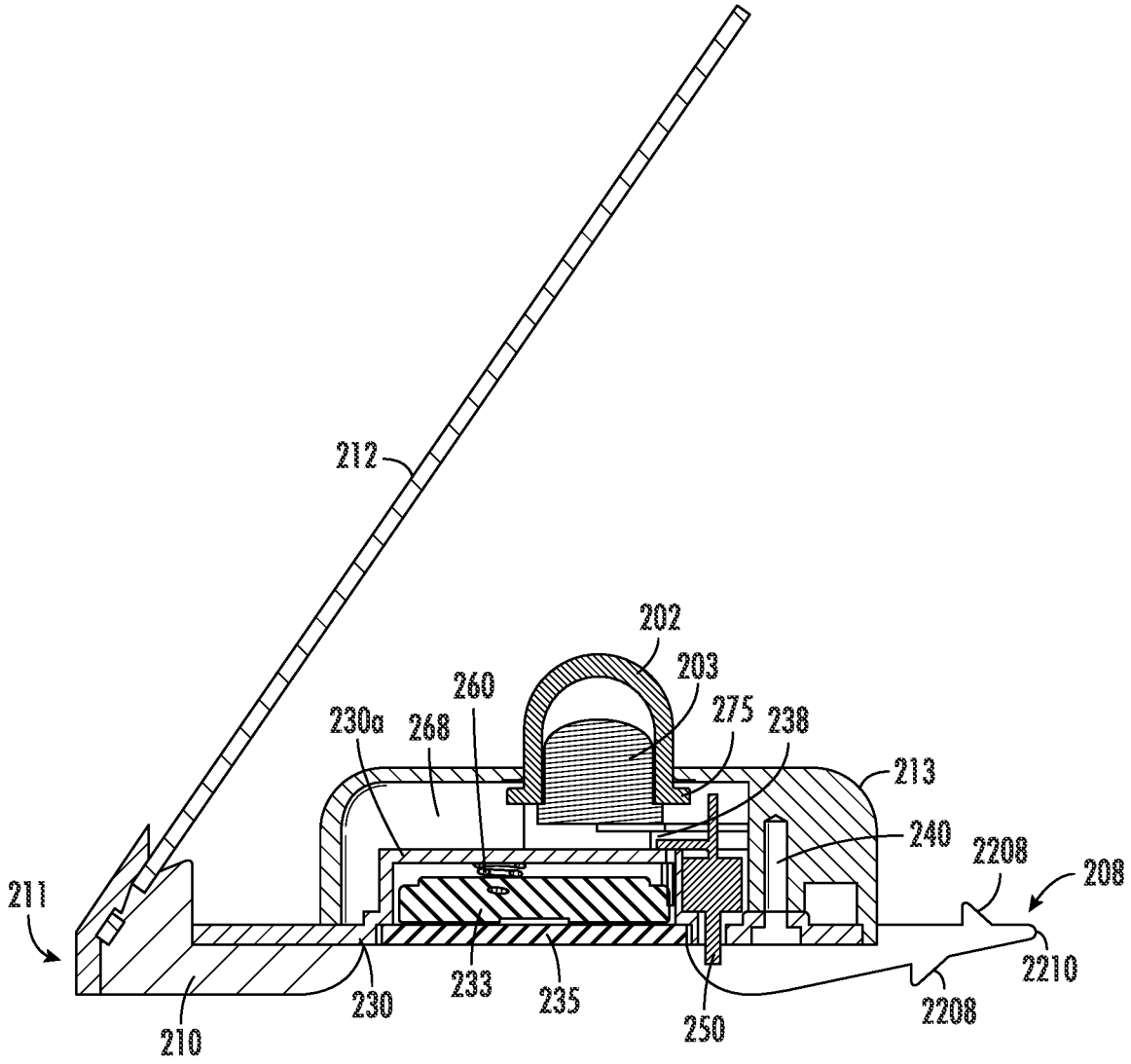
FIG. 6 is a section view of the illuminated device shown in FIGS. 4 and 5.

FIG. 6 is a section view of the light unit 200. Owing to the sectional nature of FIG. 6, this figure shows components that would normally be hidden from view in the light unit 200. For example, as mentioned above, with regard to the lighting device 203 which would typically comprise an LED light, the main housing 213 has a hole in its top through which the lighting device 203, and its associated light cover 202, protrude. By virtue of this arrangement, the light produced by the lighting device 203 can reach the reflector 212. The light cover 202 is preferably made of a transparent or translucent plastic. Preferably, the lighting device 203, with the light cover 202, is configured to project light substantially omnidirectional, and at least toward both the front and toward the rear of the pumpkin interior, for the reasons discussed above. The light cover 202 may also be formed of different color plastic to provide color to the light that reaches the reflector 212.

As is clearly visible in FIG. 6, a step shaped substrate 230, acting a light-bearing substrate, extends horizontally from a top shelf of the lower substrate 210, starting at the clip 211 and continues across the illuminated display device 200. In so doing, the step shaped substrate 230 extends up to, at a higher level, to form the lighting substrate 230*a* of the light-bearing substrate, the bottom surface of the lighting substrate 230*a* forms the top of a battery chamber in which the battery 233 is located. The top of the battery 233 is spaced apart from the underside of the lighting substrate 230*a* by a spring 260. The battery 233 can by any standard or custom designed battery with a sufficient voltage to, upon a turning on of the illuminated display device 200, drive an LED or other light source that forms the lighting device 203, and that is sufficiently small to fit in the battery compartment.

Beneath the battery 233 is an openable battery compartment door 235. As will be discussed below with respect to FIG. 7, the compartment door 235 allows for replacement of the battery 233. An upwardly extended portion of the ON/OFF switch for the lighting is shown in both FIG. 6 and FIG. 7.

A vertical support column 240 is provided in a solid portion of the main housing 213. The main housing 213 is hollow over most of its longitudinal extent and form a chamber 268 in which the battery chamber and the bottom portion of the lighting device 203, and a lower annular rim 275 of the light cover 202 are arranged.

Figure 7:
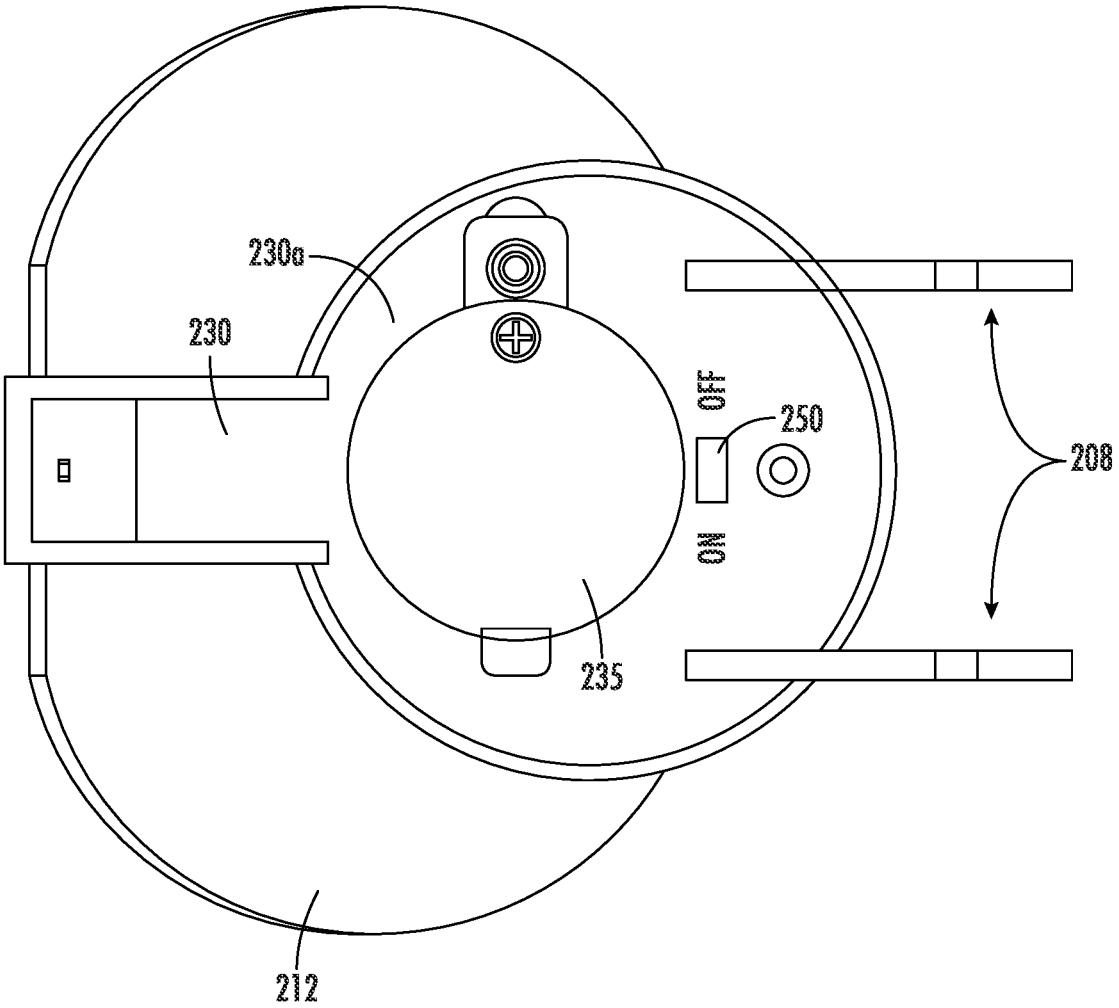
FIG. 7 is an underside plan view of the illuminated display device shown in FIGS. 4, 5 and 6.

The ON/OFF switch 250 is, for example, as best seen in FIG. 7, a slide switch, the sliding of which to the ON position cause the contact 238 to contact the lighting device 203 to apply current from the battery 233 to the lighting device, causing it to light. The battery compartment door 235 preferably is either sealed, if the illuminated display device 200 is intended to be thrown away upon the battery losing power, or had a latch, allowing a user access to the battery 233 for replacement as needed.

As in the illuminated display device 100, in the light device 200, light source/device 203 produces light at least a portion of which is directed away from the front of the pumpkin. The reflector 212 of each light device 200 is configured, with its forward tilt, and arranged at a rear portion of the illuminated display device 200, so as to reflect light from the light source 203 that is incident on the reflector 212 toward the front inner surface of the pumpkin, and, in particular, to direct respective light beams of relatively high intensity out of the front of the pumpkin/jack-o-lantern, in particular, out of the eye cutouts 18*a* and 18*b*.

That is, due to the arrangement and configuration of the reflector 212 in relation to the inner dimensions of the pumpkin and the other components of the light device 200, at particular regions in the eye cutouts 18*a* and 18*b*, namely at regions 20*a* and 20*b* as seen by a viewer viewing the front face of the jack-o-lantern, high intensity areas of light are projected from eye cutouts to provide the impression that the jack-o-lantern's eyes are staring at the viewer and follow the viewer as the viewer passes in front of the jack-o-lantern.

As in the case of the illuminated display device 100, in the illuminated display device 200 the reflector 212 is configured so as to create the regions of intensity 20*a* and 20*b*, to provide the visual impression to the user that the eyes of the jack-o-lantern are staring at the user, and, in a preferred embodiment, the reflector and the light source are configured and dimensioned such that the reflected light provides to a viewer of the pumpkin face with the visual impression that the eyes of jack-o-lantern are watching the user, that is, following the user, as the user moves from left-to-right or from right-to-left in front of the jack-o-lantern.

To provide a correct angle between the reflector 212 and the substrate 230 and for pumpkins of different sizes, the consumer of the inventive light device will preferably use an eye size that is an approximate size appropriate.

In view of the foregoing, a method of putting together the jack-o-lantern using the present invention involves the steps of:

forming a jack-o-lantern having face holes, namely one or more eye holes;

deploying the reflector of each illuminated display device to the forward tilted operational angle;

inserting the spikes of each illuminated display device into locations beneath a respective one of the eye holes.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concepts disclosed herein.

What is claimed is:

1. An illuminated display device for a hollowed-out container having face holes, the illuminated display device being installable in an inner volume of the container that is carved in a jack-o-lantern configuration of a pumpkin having the face holes and positioned at a front outer surface of the container, the illuminated display device comprising:

a light bearing substrate;

a light source emitting light substantially omnidirectionally, the light source being arranged on the light bearing substrate;

one or more spikes configured to be releasably engageable with an inner surface of the jack-o-lantern, at least one of said one or more spikes protruding outward from a front portion of the light bearing substrate and having at least one barb configured to facilitate installation of the illumination display device into the flesh of the pumpkin at the inner surface of the jack-o-lantern to secure the positioning of the illuminating display device within the jack-o-lantern proximate one of the face holes; and a reflector coupled to a rear portion of the light bearing substrate so as to hold the reflector at an upright tilted operational angle, the reflector positioned distally from the spike and arranged to extend at the upright tilted operational angle with respect to the light bearing substrate and toward the spike and above the light source to direct light from the light source through at least one of the face holes to provide the impression that the eye of the jack-o-lantern is following a passerby, wherein the reflector is hingedly connected to the light bearing substrate so as to allow the reflector to be swiveled between (i) a storage position where the reflector is proximate the light bearing substrate and (ii) the upright tilted operational angle when the reflector is in a deployed position.

2. The illuminated display device according to claim 1, wherein the light is directed by the reflector by reflection.

3. The illuminated display device according to claim 1, further comprising a main housing, configured to cover the light bearing substrate and having an aperture at its top to permit the light source to protrude through the aperture.

4. The illuminated display device according to claim 1, wherein each of the spikes has a shaft, a pointed tip and at least one barb arranged on the shaft, the at least one barb being configured to facilitate installation of the illuminated display device into the flesh of pumpkin at the inner surface of the jack-o-lantern, but to inhibit removal of the illuminated display device once it has been installed.

5. The illuminated display device according to claim 1, wherein the reflector is coupled to a rear portion of the light bearing substrate so as to hold the reflector at an angle so that the light from the light source is emitted through the face holes of the container.

6. The illuminated display device according to claim 1, further including a battery configured to selectively provide electric power to the light source to cause the light source to light.

7. The illuminated display device according to claim 6, further comprising a battery door openably affixed to the bottom of the illuminated display device, an upper surface of the battery door and an inner surface of the light bearing substrate cooperating to form a battery chamber.

8. The illuminated display device according to claim 7, further comprising an ON/OFF slide switch configured to reciprocate between a first ON position in which current flows from the battery to the light source and a second OFF position in which current cannot flow from the battery to the light source.

9. The illuminated display device according to claim 1, wherein the face holes comprise a pair of eye cutouts.

10. The illuminated display device according to claim 1, wherein the reflector comprises a plate of transparent material.

11. The illuminated display device according to claim 1, wherein the reflector extends from the bottom of the illuminated display device in a direction toward the front and above the light source.

12. The illuminated display device according to claim 1, wherein the light source has a transparent or translucent cover that is configured to color the light from the light source.

13. The illuminated display device according to claim 1, wherein the light bearing substrate has a slot.

14. The illuminated display device according to claim 1, wherein the reflector is made of plastic.

15. A method of putting together the jack-o-lantern using two instances of the illuminated display device according to claim 1, the method comprising:

forming a jack-o-lantern having face holes, namely one or more eye holes from the pumpkin;

deploying the reflector of each of the two illuminated display devices to a forward tilted operational angle; and inserting the spikes of each illuminated display device into locations beneath a respective one of the eye holes.

* * * * *